US006598368B1

(12) United States Patent
Haida

(10) Patent No.: US 6,598,368 B1
(45) Date of Patent: Jul. 29, 2003

(54) COTTON HOLDING DISK

(75) Inventor: Mark A. Haida, Ramsey, MN (US)

(73) Assignee: Upsher-Smith Laboratories, Inc., Minneapolis, MN (US)

( * ) Notice: Subject to any disclaimer, the term of this patent is extended or adjusted under 35 U.S.C. 154(b) by 0 days.

(21) Appl. No.: 09/990,808

(22) Filed: Nov. 20, 2001

(51) Int. Cl.[7] ..... B65B 61/22
(52) U.S. Cl. ..... 53/115; 53/527
(58) Field of Search ..... 53/115, 415, 135.1, 53/472, 139.5, 474, 527

(56) References Cited

U.S. PATENT DOCUMENTS

| | | | | | |
|---|---|---|---|---|---|
| 2,269,722 | A | * | 1/1942 | Lakso | 53/115 |
| 2,596,813 | A | * | 5/1952 | Gantzer | 53/115 |
| 2,805,531 | A | * | 9/1957 | Dimond | 53/115 |
| 2,810,245 | A | * | 10/1957 | Dimond | 53/115 |
| 2,817,934 | A | * | 12/1957 | Dimond | 53/115 |
| 2,860,464 | A | * | 11/1958 | Barthelemy | 53/115 |
| 2,895,269 | A | * | 7/1959 | Lakso et al. | 53/115 |
| 2,895,273 | A | * | 7/1959 | Lakso | 53/115 |
| 4,890,753 | A | * | 1/1990 | Duryee et al. | 53/115 |

OTHER PUBLICATIONS http://www.njmcli.com/images/Grandes_optimises/CL110_b.jpg, downloaded Oct. 18, 2001, 1 page.
http://www.njmcli.com/corp.htm, "NJM–CLI—Corporate Profile" downloaded Oct. 18, 2001, 2 pages.
http://www.njmcli.com/CL110_press.html, "NJM/CLI Model CL–110 Cottoner". downloaded Oct. 18, 2001, p. 1.
http://www.njmcli.com/tour.htm, "NJM/CLI Machinery for Packaging Industry", downloaded Oct. 18, 2001, p. 1.
Enercon brochure entitled "Compak Convertible Induction Cap Sealer", Section 1–Introduction Enercon Industries, 1 page.

* cited by examiner

*Primary Examiner*—John Sipos
*Assistant Examiner*—Louis Huynh
(74) *Attorney, Agent, or Firm*—Faegre & Benson LLP

(57) ABSTRACT

Apparatus and method for retaining cotton in a bottle using a cottoner machine which inserts cotton via a pair of rotatable cylinders alignable with a mouth of the bottle, the apparatus including a disk secured to the cylinders via a pair of collars and having a pair of apertures aligned with the cylinders, and the method including a process of positioning a planar surface of the disk closely superjacent the mouth of the bottle after insertion of the cotton.

13 Claims, 4 Drawing Sheets

COTTON HOLDING DISK

FIELD OF THE INVENTION

The present invention relates to the field of pharmaceutical packaging, more particularly, to the aspect of inserting a packing filler such as cotton into a bottle containing tablets to prevent damage to the tablets during handling and shipping.

BACKGROUND OF THE INVENTION

In the past, it has been known to insert a filler such as cotton into bottles containing tablets or pills. It is to be understood that rayon may be used in place of cotton, and that the term "cotton" as used herein means actual cotton or a cotton substitute such as rayon. Automated machines have been developed and are in use to insert cotton into each bottle in the process of packaging pharmaceutical pills for retail sale. Cotton or cotton-like filler material has been found desirable because of its resiliency and deformability to act as internal packing in the bottle, to reduce or eliminate movement of the pills or tablets in the bottle during subsequent handling in manufacturing, distribution and sales. However such cotton inserting machines suffered from a deficiency in that the cotton, being somewhat resilient, would tend to partially eject itself from the bottle immediately upon retraction of the inserting implement, causing difficulty in the operation of the machine. When the cotton rebounds and extends above the neck of the bottle after withdrawal of the insertion pusher, the projecting cotton was observed to interfere with the operation of the cottoner machine by catching or snagging on the cotton fill tube, causing the bottle to become misoriented with respect to the machine. This problem is particularly exacerbated when relatively small diameter cotton is used with relatively large diameter mouth bottles. It has been found desirable to use such small diameter cotton with large mouthed bottles to reduce or avoid the need for multiple diameters of cotton for use with various sized bottles. In the present situation, using small diameter cotton having a cross section of between 1 and 2 inches for "20 gr" (20 grams/yard rayon) with wide mouthed bottles (having an opening of about 2 7/16 inches diameter) has resulted in jam rates of between about 25 percent of the throughput. Such a jam rate is of course unacceptable.

It has been further observed that projecting cotton causes difficulty in subsequent closure of the bottle, typically by means of a cap carrying a safety seal therewithin, typically secured by induction heating and requiring an unobstructed contact between the safety seal and the top rim of the bottle.

When the cotton remained in the bottle, the closure would be able to be accomplished satisfactorily, with the cap threaded onto the bottle and the safety seal secured to the rim of the top of the bottle. However, cotton protruding substantially above the rim of the bottle top was found to interfere with the closure process, including securing the safety seal to the bottle top.

The present invention overcomes the shortcoming of the automated machines described above, by preventing substantial escape and protrusion of the cotton above the bottle top immediately after the cotton is inserted into the bottle. It is only necessary to temporarily contain the cotton in connection with the cottoner machine environment of the present invention since the machine typically has a second pusher downstream of the cotton inserter pusher to "repack" the cotton in the bottle neck prior to closure of the bottle at a further downstream station. With the present invention, jam rates have been observed to fall to something less than about one out of sixty bottles, or less than 0.0166 percent, while still using relatively small cotton diameter in relatively large diameter opening bottles. Use of a single size cotton has the advantage of reducing the sizes of cotton needed for a range of bottles to be processed of about 2 inches to about 2¾ inches mouth diameter in the Cottoner machine.

BRIEF DESCRIPTION OF THE INVENTION

DETAILED DESCRIPTION

Figure 1:
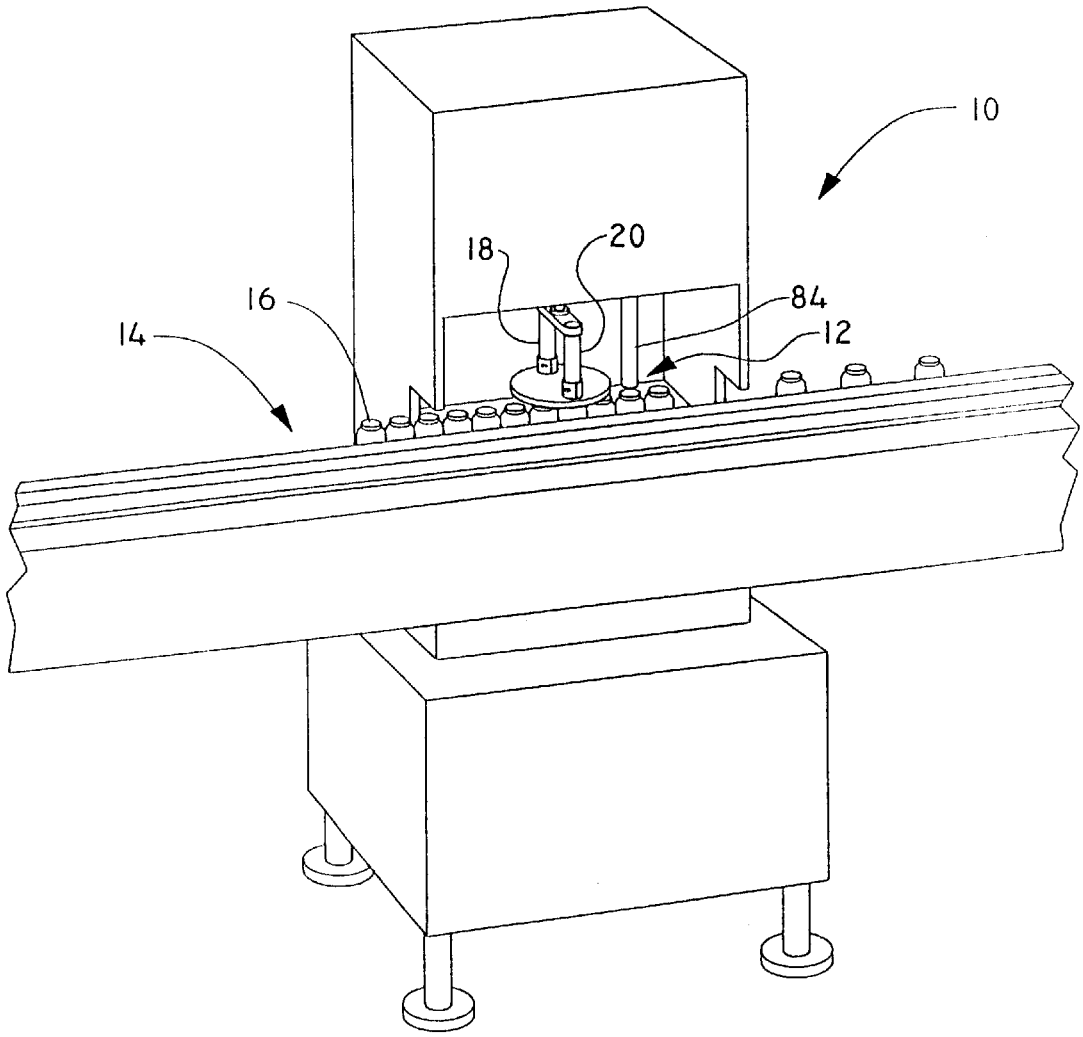
FIG. 1 is a perspective front view of a prior art "Cottoner" machine suitable for inserting cotton into bottles showing the cotton holding disk improvement of the present invention.

Referring now to the figures and most particularly, to FIG. 1, a "Cottoner" machine 10 may be seen. This machine is available from the NJM/CLI Packaging Systems International company at 56 Etna Road, Lebanon, N.H. 03766-1403 (www.njmcli.com) as a Model CL-110 COTTONER. Also included in FIG. 1 is the improved apparatus of the present invention, a cotton holding disk 12. Machine 10 has a conveyor 14 to transport a plurality of bottles 16 past the machine 10 to insert cotton therein as will be described in more detail infra. Machine 10 has a pair of inserter tubes 18, 20 which reciprocate between two positions 180 degrees apart. The reciprocation enables filling one tube with cotton while the other tube discharges cotton into a subjacent bottle. It is to be understood that the cotton is "folded" approximately in half as it is received in each of tubes 18 or 20, and will expand somewhat (in an inverted "V" orientation) once it is received in a bottle 16. Once a cotton "V" is inserted into a bottle, the tubes reciprocate 180 degrees, where the empty tube is filled with cotton, and the other tube discharges cotton to another subjacent bottle. This process is repeated continuously moving the fill tubes 18 and 20 between a discharge position proximate the bottle where the cotton is inserted into the bottle and a loading position distal of the bottle where cotton is loaded into the tube, for as long as there are bottles to be loaded with cotton. It is to be understood that prior to advancing to the machine 10, the bottles have been filled with tablets at another machine (not shown, but adjacent an upstream extension of the conveyor 14).

Figure 2:
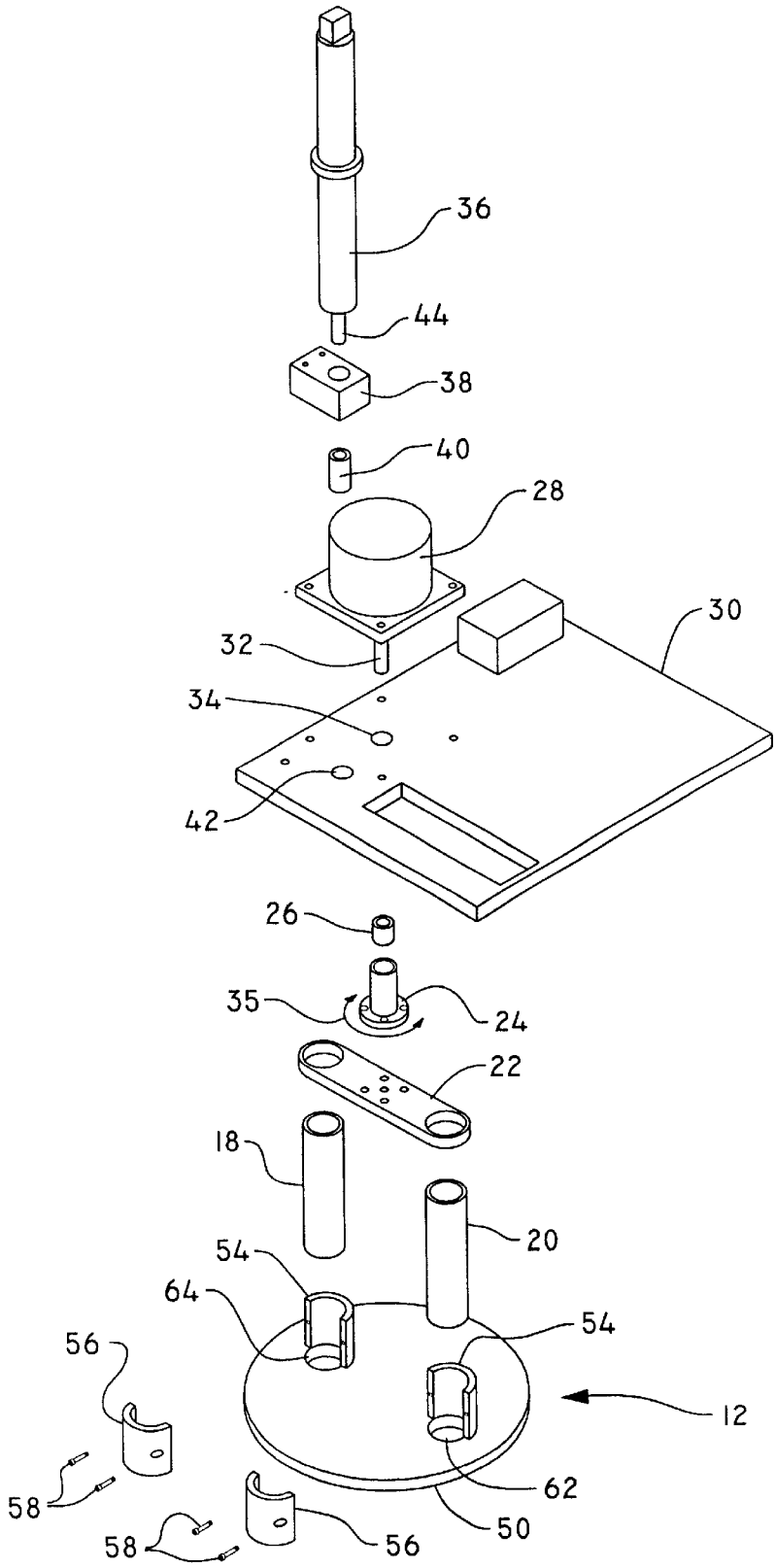
FIG. 2 is an exploded rear view of the cotton insertion station portion of the Cottoner machine of FIG. 1.
Figure 3:
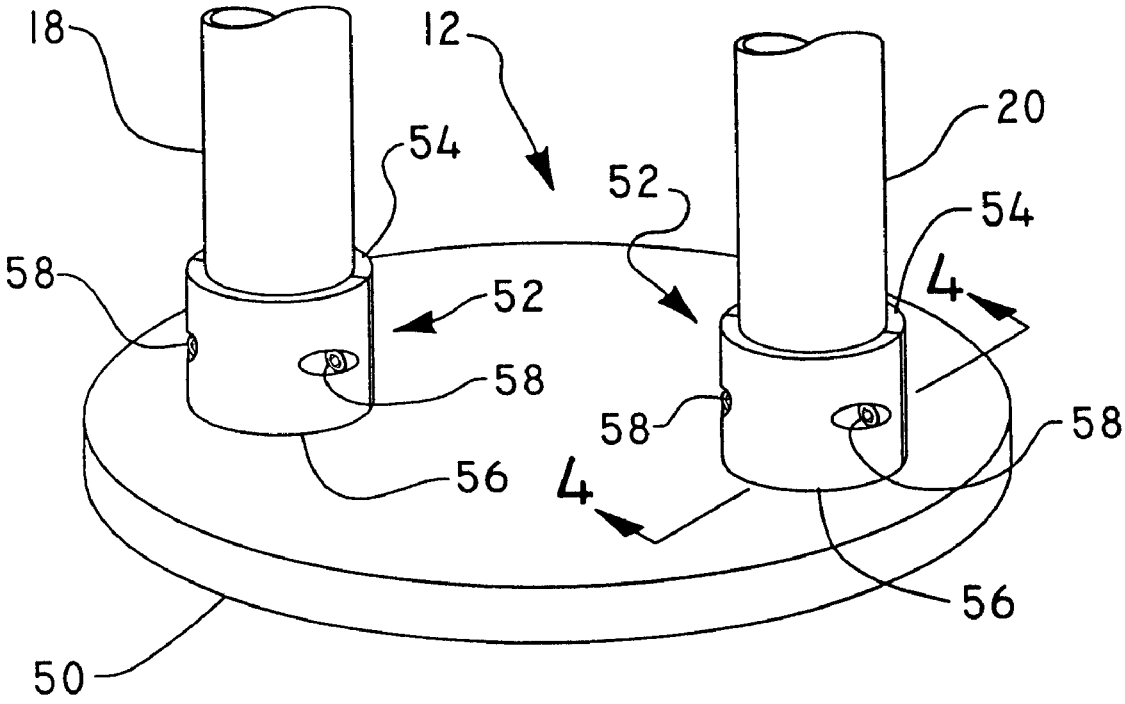
FIG. 3 is a perspective view of the cotton holding disk mounted on the cotton installing cylinders of the cottoner machine, enlarged to show details thereof more clearly.

Referring now also to FIGS. 2 and 3, tubes 18 and 20 are carried by a yoke 22 which is attached via a hub 24 and bushing 26 to a rotary actuator 28. Actuator 28 is supported on a baseplate 30 rigidly affixed to a frame (not shown) of the machine 10. A shaft 32 of actuator 28 projects through an aperture 34 of baseplate 30 to reciprocate yoke 22 and tubes 18 and 20 on command. In FIG. 3, tube or cylinder 18 is located at a loading position where cotton is inserted into tube 18, and tube or cylinder 20 is located at a discharge position where cotton previously loaded into tube 20 is discharged into a bottle, as may be seen more clearly in FIG. 4. The direction of reciprocation is indicated by arrow 35.

Referring now again to FIG. 2, an air cylinder 36 is carried by a pusher support block 38 and is operable to move a tube pusher 40 in the form of a piston able to be received in either of tubes 18 or 20. Pusher 40 is attached to and carried by a piston 44 of cylinder 36. Block 38 is rigidly attached to baseplate 30 to allow pusher 40 to project through aperture 42 in baseplate 30.

Referring now most particularly to FIG. 3, disk 12 has a generally planar plate 50, preferably with a circular periphery, and a pair of attachment collars 52. Each attachment collar 52 has a fixed portion 54 and a removable portion 56. The fixed portion 54 may be integral with the plate 50, or it may be secured thereto by any conventional means, such as threaded fasteners, preferably flat head machine screws. The removable portion 56 is preferably removably secured to the fixed portion 54 by a pair of threaded fasteners 58 such as machine screws. Collars 52 clamp disk 12 to the tubes 18 and 20. More particularly, disk 12 is attached to tubes 18 and 20 by clamping the respective removable portion 56 against the fixed portion 54 of each collar 52 with a lowermost end of the respective tube 18 or 20 gripped between the fixed and movable portions of the collar which together form a clamp. Disk 12 has a pair of apertures 62, 64 aligned with the tubes or cylinders 18 and 20. Each of apertures 62 and 64 is surrounded by one of the collars 52. It is to be understood to be within the scope of the present invention to attach disk 12 to cylinders 18 and 20 by any other conventional means.

Figure 4:
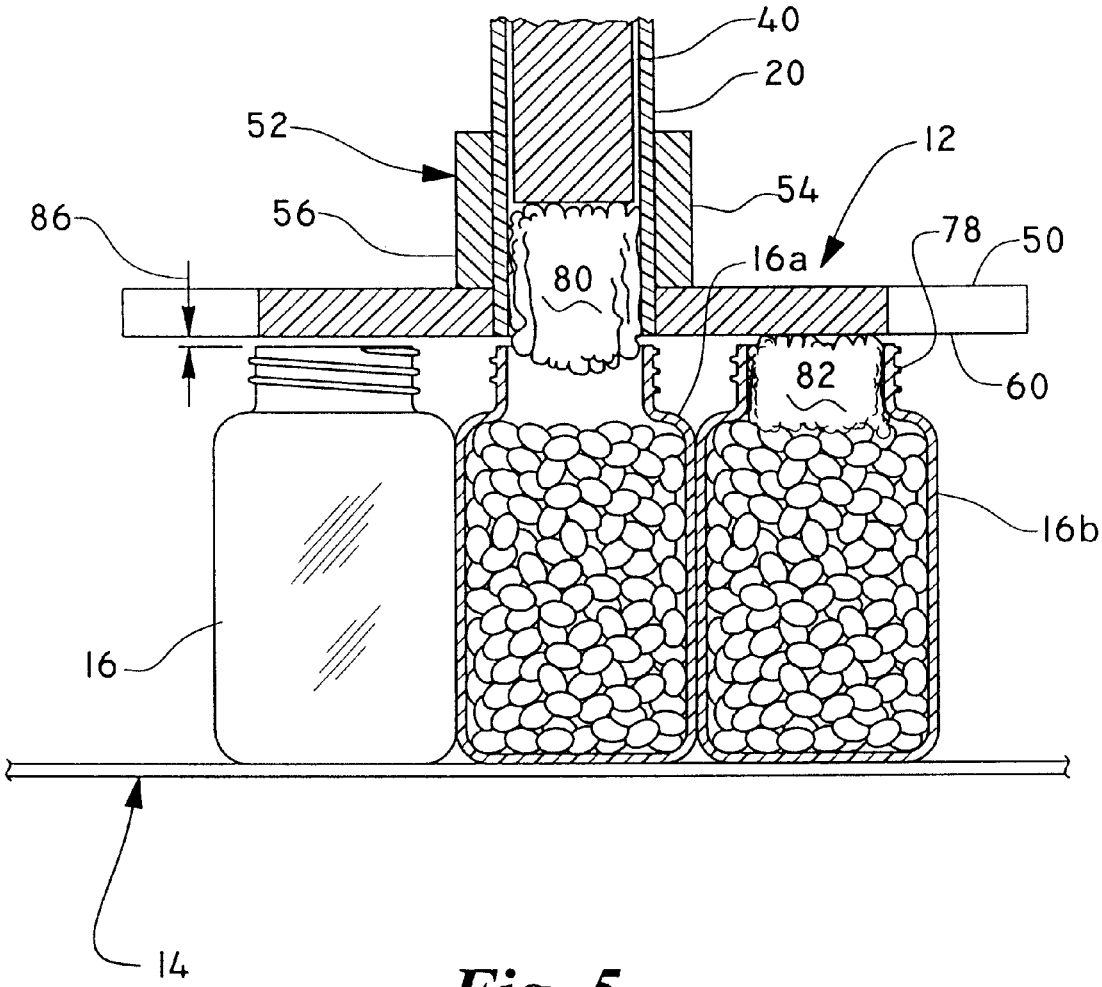
FIG. 4 is a partially sectioned fragmentary side elevation view (taken along line 4—4 of FIG. 3) of the cotton insertion station portion of the Cottoner machine shown with a plurality of bottles progressing past the station.

Referring now most particularly to FIG. 4, tube 20 preferably projects through disk 12 such that the lowermost edge of tube 20 (and tube 18) is in the same plane as a generally planar lower surface 60 of disk 12. Attachment with this alignment will avoid interference with the tops of bottles subjacent the tubes 18, 20. Alternatively, apertures 62 and 64 may have a stepped counterbore (not shown) with an upper diameter equal to the outside diameter of the tubes, and a lower diameter equal to the inside diameter of the tubes. Other aperture geometries are to be considered within the scope of the present invention, as well. For example, the lower or "exit" diameter of the aperture may have a chamfered or rounded cross section contour if the stepped counterbore is used, to reduce the chance of the cotton snagging on the exit diameter contour.

Once the cotton is inserted by pusher 40, the bottle 16 moves from position 16*a* to position 16*b* and subsequently downstream of the disk 12, where plunger 84 (visible in FIG. 1) repacks the cotton prior to bottle closure at a capping station (not shown) adjacent conveyor 14 and downstream of the machine 10.

Figure 5:
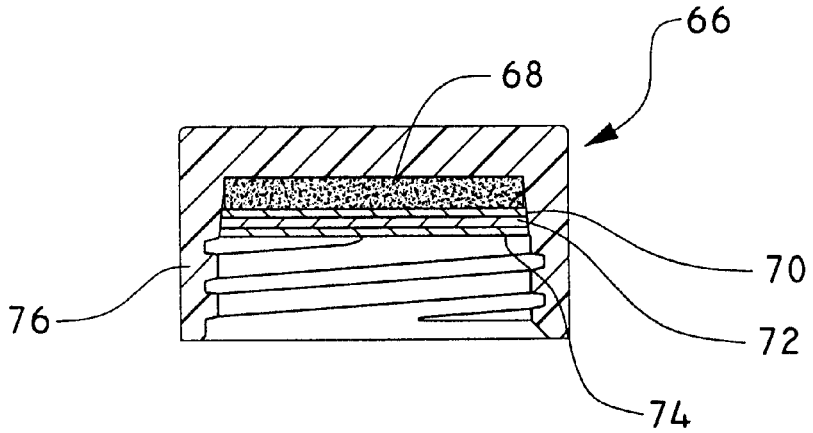
FIG. 5 is a section view of a representation of a bottle cap suitable for closing one of the bottles shown in FIG. 4.

Referring now most particularly to FIG. 5, a cap 66 for the bottles 16 may be seen. It is to be understood that cap 66 is shown in somewhat of a schematic form. Cap 66 preferably carries a layer of pulpboard 68, a layer of wax 70, a layer of aluminum foil 72 and a layer of a polymer 74 in a cover 76. It is to be understood that a laminate made up of layers 72 and 74 form a safety seal for the bottle. The aluminum layer 72 is induction heated at the capping station to melt the polymer layer to a top rim 78 of the bottle 16, after cap 66 is placed on the bottle at the capping station. When the aluminum layer 72 is heated, the wax layer 70 melts and is drawn by capillary action into the pulpboard layer 68, releasing the safety seal from the cover and layer 68.

It will be apparent that any protruding cotton may interfere with the hermetic seal formed between the aluminum layer 72 and the rim 78 of the bottle 16. It is thus important to assure the cotton remains within the bottle 16 and does not substantially protrude. Disk 12 accomplishes this by extending over the cotton filled bottle immediately downstream of the bottle immediately subjacent the tube then inserting cotton, as illustrated in FIG. 4. In FIG. 4, cotton 80 is about to be inserted from tube 20 by pusher 40 into bottle 16*a*, while cotton 82 is retained in bottle 16*b* by the lower surface 60 of disk 12.

The material of plate 50 and collars 52 may be a polycarbonate or other polymer. The plate 50 of disk 12 is preferably ¼ inch thick, but may be made thicker or thinner, as desired. It has been found suitable to insert between 1 and 4 pieces of cotton into the bottles of tablets, as desired. The clearance or spacing 86 between the planar lower surface 60 and the mouth or top of the bottle 16 is preferably about one eighth inch.

It can thus be seen that moving or positioning the lower planar surface 60 of disk 12 superjacent (closely above) the bottle 16 prevents the cotton 82 from springing back out of the bottle at location 16*b* after it is inserted by pusher 40. By maintaining the cotton under the disk 12, additional insertions of cotton have been found to be more readily retained in the bottle. Disk 12 also relieves machine 10 from jams that otherwise occur when cotton that is not set all the way into the bottle interferes with the tube 18 or 20 that is inserting it, when the tube is reciprocated to receive another load of cotton. It has been found that in the absence of disk 12, protruding cotton is susceptible of being hit by reciprocating tubes (18 or 20) causing bottles to tip over, jam or shift along the conveyor 14, interfering with the timing of the bottles on the conveyor, possibly causing conveyor jams. As has been mentioned above, after the bottle goes past the disk 12, a further plunger 84 tamps the cotton into the bottle before capping. The disk 12 has been found to enhance the tamping action of the further plunger 84. Bottles having a mouth opening of between about 2 inches diameter and about 2¾ inches diameter are believed suitable for use with the present invention. Most preferably, bottles having a mouth opening of about 2¼ to 2½ inches diameter are desirably used with the present invention. With bottles having an inside diameter opening of 2⁷⁄₁₆ inches, the jam rate has been found to be something less than 0.0166 percent using the present invention with the smaller cotton or rayon.

This invention is not to be taken as limited to all of the details thereof as modifications and variations thereof may be made without departing from the spirit or scope of the invention.

What is claimed is:

1. An apparatus for a cotton insertion having a pair of cylinders, each having substantially a same characteristic diameter and rotatably mounted for reciprocating between a loading position and a discharge position for inserting cotton into the tops of bottles, the improvement comprising a disk fixedly secured to the cylinders and having a pair of apertures each aperture having substantially the same diameter as the diameter of the cylinders and wherein the apertures are aligned with the cylinders, with the disk having a generally planar surface extending downstream for at least a width of one bottle opening diameter, and wherein the surface is located closely superjacent the tops of the bottles for retaining the cotton in the bottles after insertion of the cotton into the bottles.

2. The apparatus of claim 1 further comprising a pair of collars attached to the disk, with one collar attached to each cylinder for securing the disk to the cylinders.

3. The apparatus of claim 2 wherein the collars each have a clamp for securing the disk to the cylinders.

4. The apparatus of claim 3 wherein each clamp is formed of a fixed and a movable portion of the respective collars.

5. The apparatus of claim 1 wherein the generally planar surface is located about one eighth inch above the tops of the bottles.

6. The apparatus of claim 1 wherein the disk has a generally circular periphery.

7. A combination of a cotton insertion machine, a piece of cotton and at least one bottle, the machine having a pair of cylinders each rotatably mounted for reciprocating between a loading position and a discharge position for inserting cotton into the tops of bottles, the combination comprising a disk fixedly secured to the cylinders and having a pair of apertures aligned with the cylinders with a diameter of each of the apertures being substantially the same as an inner diameter of each of the cylinders, with the disk having a generally planar surface extending downstream for at least a width of one bottle opening diameter, and wherein the surface is located closely superjacent the tops of the bottles for retaining the cotton in the bottles after insertion of the cotton into the bottles, the combination further comprising the piece of cotton and the bottle into which the cotton is inserted wherein the cotton has a relatively small characteristic diameter with respect to the diameter of a mouth of the bottle into which it is inserted.

8. The combination of claim 7 wherein the cotton has a characteristic cross section of about 1 inch by about 2 inches and the diameter of the mouth of the bottle is between about 2 inches to about 2¾ inches.

9. The combination of claim 7 wherein the cotton has a characteristic cross section of about 1 inch by about 2 inches and the diameter of the mouth of the bottle is between about 2¼ inches to about 2½ inches.

10. The combination of claim 7 wherein the cotton has a characteristic cross section of about 1 inch by about 2 inches and the diameter of the mouth of the bottle is about 2 7/16 inches.

11. The combination of claim 7 wherein the cotton has a 20 gram/yard rating and the diameter of the mouth of the bottle is between about 2 inches to about 2¾ inches.

12. The combination of claim 7 wherein the cotton has a 20 gram/yard rating and the diameter of the mouth of the bottle is between about 2¼ inches to about 2½ inches.

13. The combination of claim 7 wherein the cotton has a 20 gram/yard rating and the diameter of the mouth of the bottle is about 2 7/16 inches.

* * * * *

UNITED STATES PATENT AND TRADEMARK OFFICE

CERTIFICATE OF CORRECTION

PATENT NO. : 6,598,368 B1
DATED : July 29, 2003
INVENTOR(S) : Mark A. Haida

It is certified that error appears in the above-identified patent and that said Letters Patent is hereby corrected as shown below:

Column 4,
Line 55, please insert a comma after the word "apertures".

Signed and Sealed this

Seventh Day of October, 2003

JAMES E. ROGAN
*Director of the United States Patent and Trademark Office*